United States Patent [19]

Rinaldi et al.

[11] Patent Number: 4,479,526

[45] Date of Patent: Oct. 30, 1984

[54] STRUCTURE WITH ADJUSTABLY-TILTABLE ARTICULATED ARMS FOR WIND UP SUNSHADE TENTS

[75] Inventors: Rinaldo Rinaldi, Bogliasco; Alberto Ghermignari, Genoa; Claudio Marcori, Genova Sampierdarena, all of Italy

[73] Assignee: Riri Italia S.p.A., Vignole Borbera, Italy

[21] Appl. No.: 555,726

[22] Filed: Nov. 28, 1983

[30] Foreign Application Priority Data

Nov. 30, 1982 [IT] Italy ..... 12680 A/82

[51] Int. Cl.[3] ..... E04F 10/06

[52] U.S. Cl. ..... 160/22; 16/241; 16/360; 135/117; 135/903

[58] Field of Search ..... 135/117, 120, 903, DIG. 5, 135/DIG. 8, DIG. 9; 160/22, 66, 67, 68, 69, 70, 72, 73; 16/241, 245, 348, 360, 345, 364

[56] References Cited

U.S. PATENT DOCUMENTS

| | | | |
|---|---|---|---|
| 2,740,470 | 4/1956 | D'Azzo | 160/22 |
| 3,782,443 | 1/1974 | Clauss et al. | 160/22 |

FOREIGN PATENT DOCUMENTS

| | | | |
|---|---|---|---|
| 2359132 | 6/1975 | Fed. Rep. of Germany | 160/22 |
| 2459995 | 7/1975 | Fed. Rep. of Germany | 160/68 |
| 2753955 | 6/1979 | Fed. Rep. of Germany | 160/22 |
| 1550331 | 11/1968 | France | 160/68 |
| 1558274 | 1/1969 | France | 160/68 |

*Primary Examiner*—Robert A. Hafer
*Assistant Examiner*—Arnold W. Kramer
*Attorney, Agent, or Firm*—Pollock, Vande Sande & Priddy

[57] ABSTRACT

A projecting structure (1) with at least two articulated stretching arms (17, 18) which can be adjustably tilted, for wind up tents, particularly sunshade tents, comprising an attachment or supporting bar (2) secured to the wall through adjustable brackets (3), a roller (13) for winding up the tent sheet (T), with a respective control winch (14), said roller being supported on the bar (2) parallel thereto between end supports (15) keyed and secured to the ends of said bar, said bar having slidably mounted thereon square-shaped support and articulation hubs (16), one for each of said articulated arms which stretch the tent sheet (T). The structure is characterized in that each of said square-shaped hubs (16) comprises an attachment hinge body (22) which is hinged, on one hand, to said hub co-axially with the square-shaped bar mounted therein and, on the other hand, to the carrier arm (17) of the respective pivoted stretching arm (17, 18) around an associated pivot (25). Between the body of the square-shaped hub (16) and the attachment hinge body (22), adjustment means (26, 27, 29, 30, 33) are provided to adjust within a pre-established adjustment range the angular position of said hinge attachment member around the longitudinal axis of said attachment bar of the extendable device for the wind up tent.

3 Claims, 5 Drawing Figures

STRUCTURE WITH ADJUSTABLY-TILTABLE ARTICULATED ARMS FOR WIND UP SUNSHADE TENTS

SUMMARY OF THE INVENTION

This invention relates to the sunshade tents of the so-called mechanical type, wherein a tent sheet is stretched and held in position, under either manual or powered control, on a projecting structure comprising a wind up roller for the tent sheet, a winch to effect a pre-established rotation of said roller in either direction, so as to selectively unwind or wind up said sheet, and an articulated framework comprising at least a pair of jointed or articulated arms each including two pivoted sections and designed to hold the tent sheet in a stretched condition and to move together with the free end thereof with respect to the wind up roller between the extended and the wound up positions.

A known type of said projecting structure for sunshade tents comprises an attachment or supporting bar, usually a square-shaped hollow box section, which is horizontally secured to a wall by means of spaced adjustable brackets, the wind up roller being operatively mounted parallel to said bar and supported longitudinally thereof, together with its winch, by means of a pair of supporting arms co-ordinately and fixedly engaged, respectively, at both ends of the square-shaped bar.

Slidably and lockably mounted on said attachment bar of the projecting structure, there are adjustable square-shaped hubs each supporting a respective jointed or articulated stretching arm for the tent, said arm being designed to move in accordance with the winding and unwinding movements of the tent.

In projecting structure for sunshade tents of the type described above, this invention provides, according to a main characteristic thereof, a square shaped hub slidably mounted on the attachment bar and provided with adjustment means for interconnecting said attachment bar with a respective articulated stretching arm designed to stretch the tent sheet and for adjusting the tilt of said arm with respect to the desired slope of the tent. Said tilt-adjusting means comprise a hinge or pivotal connection for one end of the stretching arm with the body of the hub, concentric with said square-shaped bar, and a curved guide-slot connection, congruous with said hinge connection, between a curved guide slot on said body of the hub and a pivot pin engaged with said arm parallelly to the hinge axis, this connection being angularly adjustable by means of an adjusting screw which is rotatably mounted in the body of said hub and which controls a threaded nut-slider which engages said pivot pin and controls the position thereof in the guide slot of the respective square-shaped hub mounted on the attachment bar.

According to another feature of the invention, said hinge connection at the end of the stretching arm on the body of the square-shaped hub mounted on the wall attachment bar for the tent, comprises a ball-and-socked joint permitting a limited angular axial adjustment between said bar and the hub mounted thereon. By this adjustment, an exact positioning is obtained of the tent-stretching arms even in case of any small misalignment of said square-shaped attachment bar.

BRIEF DESCRIPTION OF THE DRAWINGS

These and other features of the invention and the advantages resulting therefrom will be apparent from the following detailed description of a preferred embodiment thereof, shown as a non-limitating example in the accompanying drawings, wherein.

DESCRIPTION OF THE PREFERED EMBODIMENT

Figure 1:
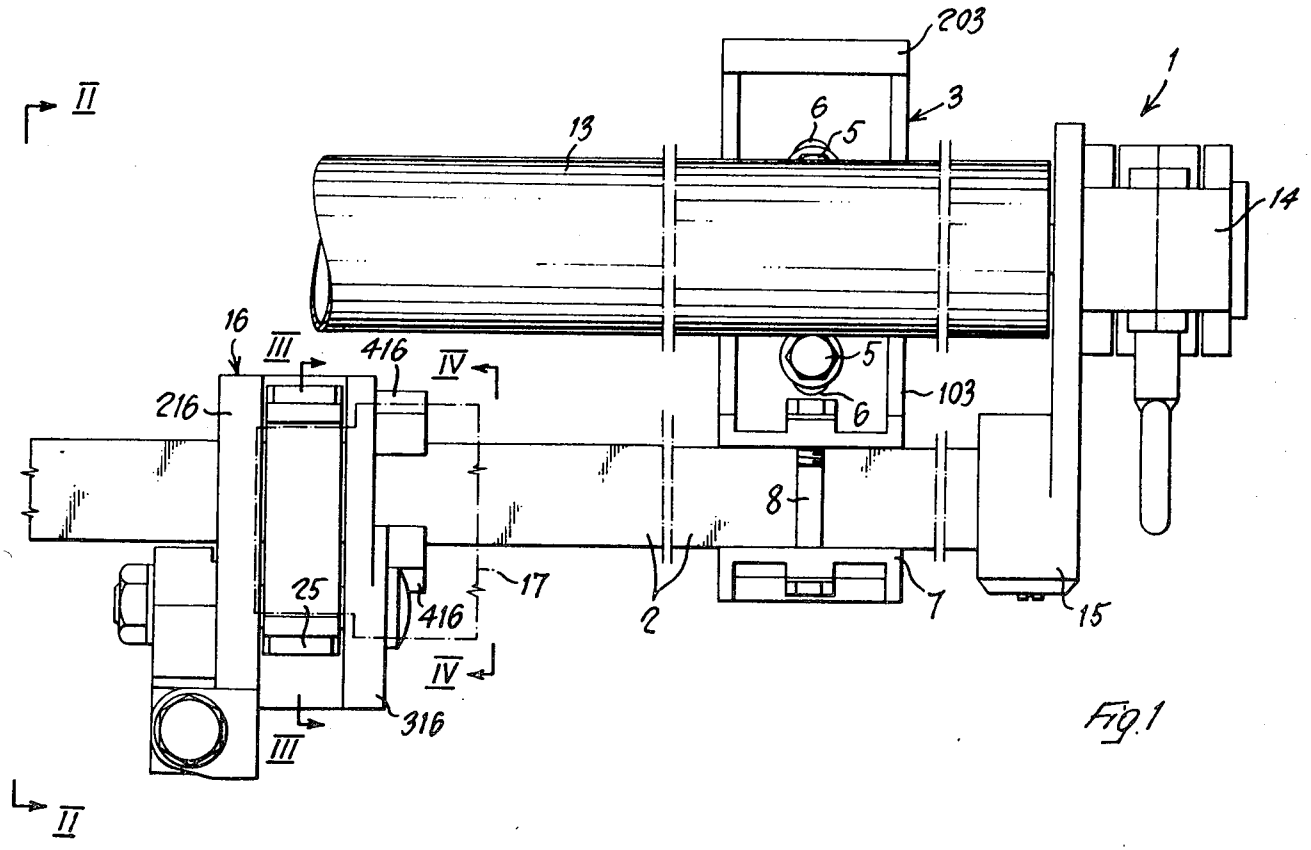
FIG. 1 is a front elevational view of one of the end portions of a wall attachment structure for a wind up tent, mounted on a fixed horizontal square-shaped bar having mounted thereon the square-shaped hubs which support in a tilt-adjusting manner the respective articulated stretching arms for the tent sheet.
Figure 2:
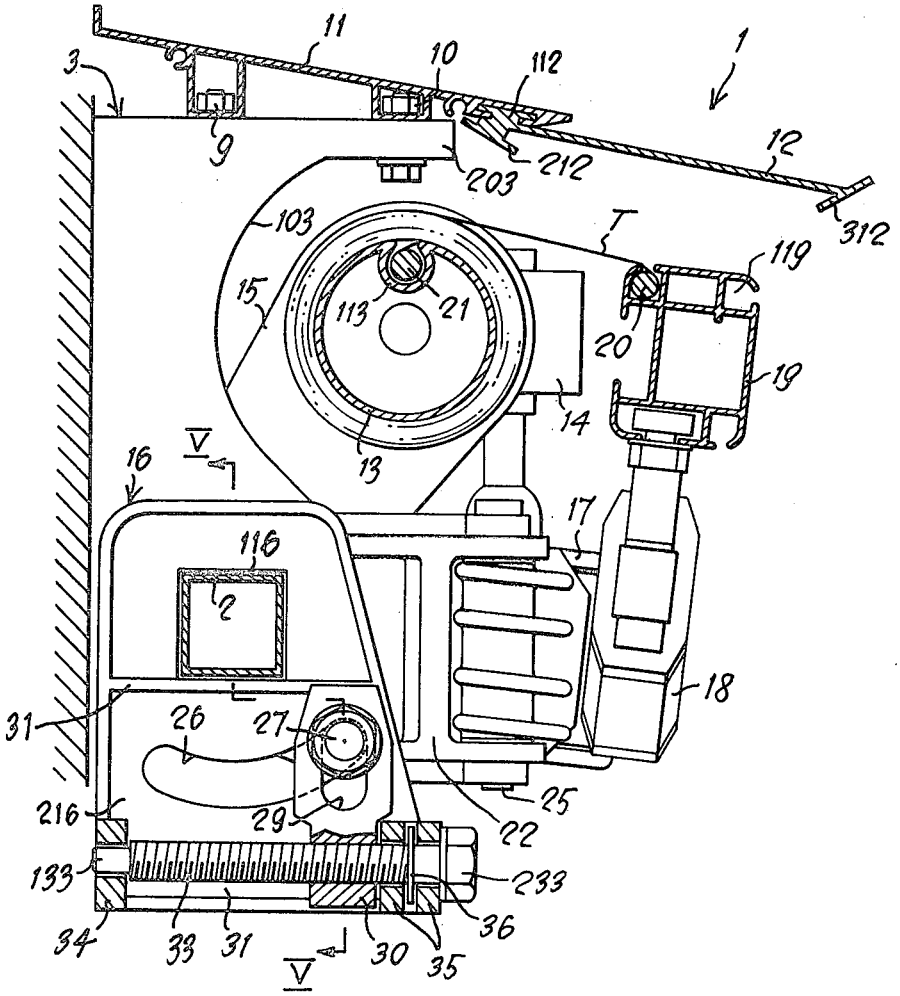
FIG. 2 is a side elevational view of the same end portion of the structure, viewed as indicated by the arrows II—II in FIG. 1.
Figure 3:
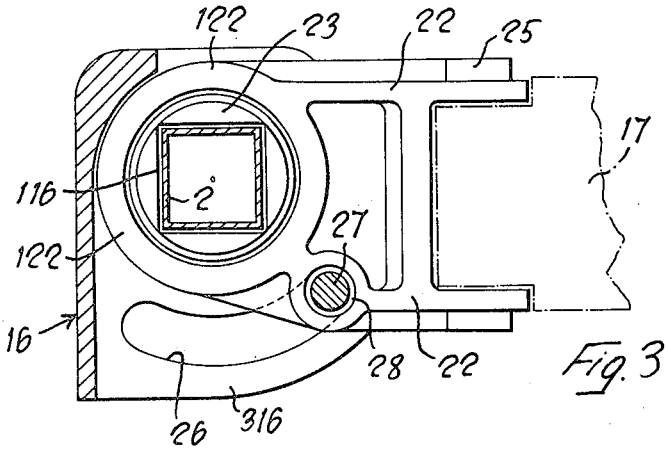
FIG. 3 is a cross sectional view of the same end portion of the structure on the line III—III of FIG. 1 and shows one of the square-shaped hubs of the invention connecting the respective articulated stretching arms for the tent sheet to said bar.
Figure 4:
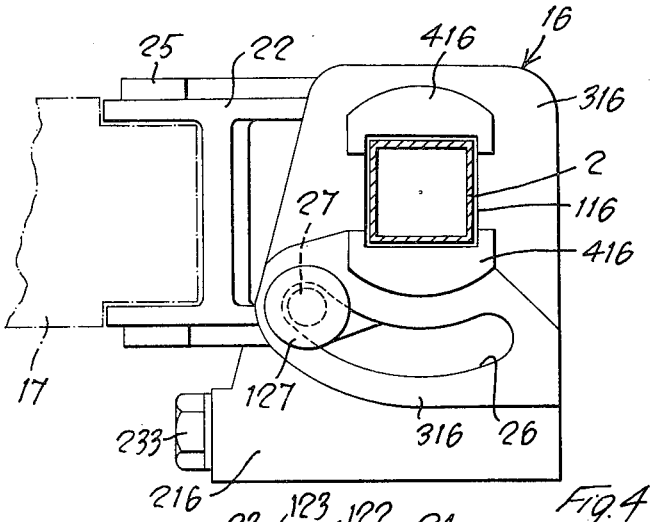
FIG. 4 is a side elevational view of said square-shaped hub, viewed in the direction indicated by the arrows IV—IV in FIG. 1.

With reference to the Figures, the invention comprises a projecting structure 1 for wind up tents T, comprising a horizontal attachment bar 2, preferably consisting of a square-shaped hollow box section. This attachment bar is secured to the wall, parallelly thereto, by means of supporting brackets 3 which are, in turn, fixed to the wall by screw members 5, the level of said brackets being adjustable in that said screw members 5 are engaged in vertical elongated slots 6 in the brackets. Each bracket 3 comprises in the lower portion thereof a suitable throat 7 matingly accommodating the bar 2, and a setscrew 8 is then placed transverse to the throat 7 to prevent the bar 2 from displacing.

Above the throat 7 accommodating the square-shaped bar 2, each bracket 3 presents a wide recess 103 having the configuration of an arc of circumference and with a flat upper end portion 203. The latter has affixed thereto by means of screws 9, 10 an attachment plate 11 of a small roof-like member comprising an end flap or shield 12 which may be variously affixed to the plate 11 by different tenon formations 112, 212, 312.

The wind up roller 13 for the tent sheet T, with the associated control winch 14, is supported parallel to the attachment bar 2 by a pair of supporting arms 15 which are keyed on the respective ends of said bar, in a forwardly inclined position in the unwinding direction of the tent.

Slidably mounted on the square-shaped bar 2 through corresponding square-shaped bores 116, are the articulated mounting hubs 16 for the articulated stretching arms 17, 18 supporting the composite beam 19 constituting the front member of the tent and comprising channels 119 for accommodating the anchorage rod 20 fitted at the front edge of the tent sheet T. A similar rod 21, fixed longitudinally of the rear edge of the tent sheet T and inserted in a suitable seat 113 of the wind up roller 13, constitutes the rear anchorage of the tent sheet T to said roller.

According to the invention, each of said articulated supporting hubs 16, associated with a respective stretching arm 17, 18 for the tent, substantially comprises a hinge body 22 one end of which comprises a collar 122 rotatably mounted on a square-bored bearing 23 slidably mounted on the bar 2 between the two cheeks 216, 316 of the body of said hub 16. The cheek 316 comprises two lateral extensions 416 provided with diametrically opposite threaded holes wherein two respective grub-screws 24 are screwed for locking the hub 16 in position on the bar 2.

On the other side, the hinge body 22 is provided with a hinge 25 for connection with the end portion 17 of the associated articulated arm 17, 18 designed to stretch the tent sheet T. Therefore, and as shown in the drawings, the hinge body 22 is hinged on the hub 16 co-axially with the square-shaped bar 2, thus permitting the vertical pivotal movement of the associated arm 17, 18. The amplitude of this movement, and therefore the slope of the tent, can be adjusted by providing suitable adjusting means in the hub 16, which, according to a characteristic of this invention, comprises a pair of curved guide slots 26 formed in the cheeks 216, 316, respectively, of the body of said supporting hub 16, co-axially with the longitudinal axis of said bar 2.

Said guide slots 26 are engaged simultaneously by the stem of a bolt 27 also passed through a transverse hole 28 of the hinge body 22 and through a slot 29 of a positioning slider 30 which is engaged laterally against the outer side of the cheek 216 of the body of said hub 16 and is slidably guided between the opposite sides 31 of a horizontal recessed area in said body.

The bolt 27 is formed, adjacent its head 127, with a square portion 227 engaged with the guide slot 126 in the cheek 316, thus preventing the bolt from rotating, while the nut 32 holds the slider 30 in place, first loosely and then firmly in the desired adjusted position of the hinge body 22. This adjusted position is achieved in that the angular positioning slider 30 for the hinge body 22, with respect to the square hub 16, is engaged operatively, in the direction of the slide recess 31, by an adjusting or control screw 33 which is screwed through a threaded hole thereof and is rotatably supported within said hub in a rear end bearing 34 supporting its reduced cylindrical end 133, and in a pair of closely-spaced front end bearings 35, and beyond them said control screw 33 is provided with a faceted control head 233. The adjusting or control screw 33 is loosely retained by a locked washer 36 which is loosely engaged between the two bearings 35 so as to prevent any axial displacement thereof in response to its rotation, which causes the slider 30 to move and drag the bolt 27 therewith within the guide slot 26.

As a result, the hinge body 22 is compelled to effect, around the pivotal connection 122, angular oscillations which depend upon the rotation of the screw 33, so as to control, as desired, the inclination of the stretching arms 17, 18 for the tent sheet and, therefore, the slope of the tent as a function of the positioning of the slider 30 along the sliding guide 31. When this positioning has been achieved by the action of the screw 33, the slider 30 may be locked firmly in position by tightening the nut 32 of the bolt 27.

Figure 5:
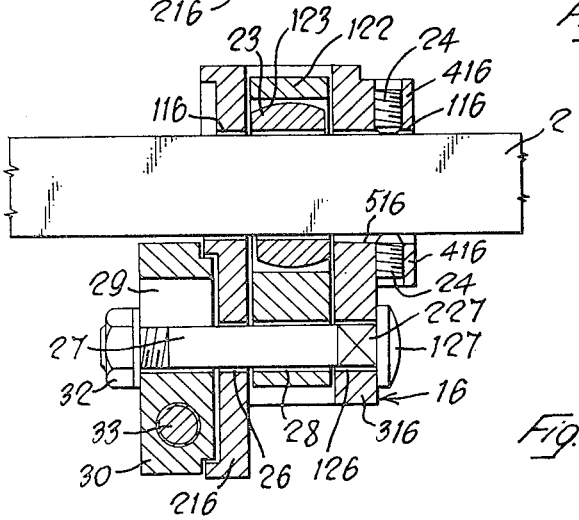
FIG. 5 is a sectional view of the square-shaped hub on the broken line V—V of FIG. 2.

As appearing from the sectional view of FIG. 5, the square bore 116 in the cheek 316 of the hub 16 is characterized in that its lower face 516 is flaring or diverging outwardly, so as to permit a small longitudinal angular clearance between the hub and the square-shaped bar 2 passed therethrough.

In accordance with this clearance, the square-bored bearing 23 has an outer circular crowning 123 which allows for this clearance without hindering the vertical oscillation of the hinge connection 22, 122 of the stretching arm 17, 18 protruding therefrom.

Said angular clearance between the hub 16 and bar 2 is locked by tightening the opposite grub-screws 24. Thus, the correct positioning of the hubs, and therefore of the stretching arms supported thereby, is achieved at all times even if the bar 2 is not mounted in a perfectly horizontal position.

Obviously, the invention is not limited to the embodiment herein shown and described as a non limitating example, and broad changes and modifications can be made thereto.

We claim:

1. A projecting structure (1) with adjustably tiltable articulated stretching arms (17, 18), for wind up tents, particularly sunshade tents, comprising a square-shaped attachment bar (2), affixed horizontally to a wall through adjustable brackets (3), a roller (13) for winding up the tent sheet (T), with a respective control winch (14), said roller (13) being supported on said bar (2) parallelly thereto, between end supports (15) keyed and secured to the ends of said bar, said bar (2) having slidably mounted thereon a plurality of square-shaped support and articulation hubs (16), one for each of said stretching arms (17, 18) which stretch the tent sheet (T), characterized in that each of said square-shaped hubs (16) comprises an attachment hinge body (22) which is hinged, on one hand, to said hub (16) co-axially with the square-shaped bar (2) mounted therein and, on the other hand, to the arm (17) which carries the respective stretching arm (17, 18) around an associated pivot (25), adjustment means (26, 27, 29, 30, 33) being provided between the body of the square-shaped hub (16) and the attachment hinge body (22), to adjust within a pre-established adjustment range the angular position of said hinge attachment body (22) around the longitudinal axis of said attachment bar (2).

2. A structure according to claim 1, characterized in that said adjustment means to adjust within a pre-established adjustment range the angular position of the hinge attachment body (22) connecting an articulated stretching arm (17, 18) to the respective supporting hub (16) on the attachment bar (2), comprises guide-slot connection between a pair of corresponding guide slots (26) formed in two cheeks (216, 316), respectively, of the body of said hub, and a pin (27) passed through a respective hole (28) of the attachment body, said pin (27) also engaging a positioning slider (30) slidably guided in a recessed area (31) of said hub (16) and adapted to be actuated by a control screw (33), said control screw (33) being rotatably but not axially slidably mounted in the body of the hub.

3. A structure according to the claim 1, characterized in that the hinge connection between said attachment body (22) and the respective hub (16), co-axially with said square-shaped attachment bar (2), comprises a square-bored collar or bearing (23) with an outer circular crowning (123) whereby permitting a limited pivotal movement of said hinge connection, while the square bore (116) of the hub (16) has a flaring lower face (516) on the side comprising grub-screws (24) for locking the hub on the bar, so as to permit in any case a correct planar positioning of the stretching arms even in case of possible small misalignment of said attachment bar.

* * * * *